US007406995B2

(12) United States Patent
Huang

(10) Patent No.: US 7,406,995 B2
(45) Date of Patent: Aug. 5, 2008

(54) PULL CORD DEVICE AND WINDOW COVERING INCLUDING THE SAME

(76) Inventor: Tai-Long Huang, No. 382, Yuan-Lu Rd., Sec. 1, Fuhsing, Changhua (TW)

( * ) Notice: Subject to any disclaimer, the term of this patent is extended or adjusted under 35 U.S.C. 154(b) by 96 days.

(21) Appl. No.: 11/278,480

(22) Filed: Apr. 3, 2006

(65) Prior Publication Data

US 2006/0278348 A1 Dec. 14, 2006

(30) Foreign Application Priority Data

Jun. 14, 2005 (TW) ..... 94119611 A

(51) Int. Cl.
*E06B 9/30* (2006.01)

(52) U.S. Cl. ..... 160/170; 160/178.2

(58) Field of Classification Search ..... 160/170, 160/171, 178.1 R, 84.04, 84.05; 242/166, 242/325, 333, 227, 575.2, 343.2; 185/7, 185/13, 40 R, 39

See application file for complete search history.

(56) References Cited

U.S. PATENT DOCUMENTS 5,482,100 A * 1/1996 Kuhar ..... 160/170
6,024,154 A * 2/2000 Wang et al. ..... 160/170
6,289,965 B1 * 9/2001 Ruggles ..... 160/170
6,644,375 B2 * 11/2003 Palmer ..... 160/170
6,761,203 B1 * 7/2004 Huang ..... 160/170
7,025,107 B2 * 4/2006 Ciuca ..... 160/170
2002/0157796 A1 * 10/2002 Judkins ..... 160/84.04
2004/0108079 A1 * 6/2004 Gilmore et al. ..... 160/170
2007/0227677 A1 * 10/2007 Yu et al. ..... 160/170

* cited by examiner

*Primary Examiner*—Brian E. Glessner
*Assistant Examiner*—Samuel S Lin
(74) *Attorney, Agent, or Firm*—Hunton & Williams LLP

(57) ABSTRACT

A pull cord device for controlling raising and lowering of a base rail of a window covering includes a locking wheel having a toothed segment turnable between locked and unlocked positions to engage and disengage from a cord spool, respectively, a cord-release controlling member having a cord retaining region to engage a pull cord to be movable along a linear running path when the pull cord is pulled in the unlocked position, a guideway disposed in the locking wheel, and including an angularly extending first route and a looped route, a guided member having a key end disposed in the guideway, and a linkage coupling the controlling member with the locking wheel such that when the controlling member is moved, the locking wheel is turned from the locked position to the unlocked position, and such that, in the unlocked position, the cord retaining region remains unmoved in each of regions in the looped route.

11 Claims, 17 Drawing Sheets

PULL CORD DEVICE AND WINDOW COVERING INCLUDING THE SAME

CROSS-REFERENCE TO RELATED APPLICATION

This application claims priority of Taiwanese Application No. 094119611, filed on Jun. 14, 2005.

BACKGROUND OF THE INVENTION

1. Field of the Invention

This invention relates to a pull cord device and a window covering including the same, more particularly to a pull cord device which employs a cord-release controlling member to control a locking wheel so as to permit or prevent rotation of a cord spool for moving or positioning a base rail relative to a header rail of the window covering.

2. Description of the Related Art

A conventional "cordless" window covering, such as those disclosed in U.S. Pat. Nos. 6,079,471 and 6,289,965, generally includes a spring motor to raise or lower slats between header and base rails of the window covering. The spring motor includes a take-up drum, a drive drum, and a coil spring interconnected between the take-up and drive drums, with its biased or relaxed position being wound upon the take-up drum. The coil spring can be of constant or variable force, and cooperates with a friction adjuster to balance the weight of the base rail and accumulated slats on the base rail so as to position the base rail at a desired height. However, since windows have different dimensions, window coverings are required to have different sizes. Hence, the weights of the base rails and slats of different window coverings vary. Consequently, the spring motors mounted on the window coverings are required to have coil springs with different biasing forces, and matching friction adjusters with different frictional forces, thereby rendering mass production of window coverings difficult.

Referring to FIGS. 1 and 2, a cordless blind disclosed in U.S. Pat. No. 6,024,154 is shown to include a header rail 1, a base rail 2, a plurality of slats 3, two pull cords 4, a winding member 5, and a positioning member 6. The winding member 5 includes a housing 501, two cord retrieving and winding wheels 502 rotatably mounted in the housing 501, and two coil springs 503 connected to the housing 501 and the respective cord retrieving and winding wheels 502. Each of the cord retrieving and winding wheels 502 has a winding portion 504 for winding the respective pull cord 4, and a toothed retaining portion 505. The positioning member 6 has a retaining body 601 and a plurality of springs 602 abutting against the housing 501 and the retaining body 601. The retaining body 601 has two racks 603 disposed to respectively mesh with the toothed retaining portions 505 of the cord retrieving and winding wheels 502. When the retaining body 601 is pressed to cause the racks 603 to disengage from the toothed retaining portions 505, a further pressing force can initiate the wheels 502 to wind the pull cords 4 by means of the coil springs 503 so as to raise the slats 3. On the contrary, when the base rail 2 is pulled downwardly by hand to lower the slats 3 and is then released, the racks 603 will return to their original position by means of the springs 602 to mesh with the toothed retaining portions 505 so as to stop the rotation of the wheels 502, the base rail 2 is thus positioned at a desired height.

Such a cordless blind has the following drawbacks:

1. As shown in FIGS. 2 and 3, since the winding and positioning members 5, 6 are located at a central portion of the base rail 2, and since the user usually uses one hand to press the retaining body 601 and press or pull the base rail 2, the wheels 502 are not able to wind the pull cords 4 evenly thereon. Thus, the base rail 2 tends to slant to one side.

2. Since lower ends of the pull cords 4 are wound on the wheels 502, once the base rail 2 slants to one side as shown in FIG. 3, the user has to press the retaining body 601 with one hand, and pull a higher part of the base rail 2 with the other hand. The adjusting operation as such is relatively inconvenient to conduct.

SUMMARY OF THE INVENTION

The object of the present invention is to provide a pull cord device for a window covering which is convenient to operate and which is suitable for different window coverings of varying dimensions.

According to this invention, the pull cord device includes a locking wheel mounted on and to be rotatable relative to a housing disposed on one of a header rail and a base rail of a window covering about a wheel axis, and including a rim which surrounds the wheel axis, a surrounding major wall which extends from the rim in radial directions and towards the wheel axis, and a toothed segment which is disposed on the rim, and which is turnable between a locked position where the toothed segment engages a toothed gear wheel of a cord spool, and an unlocked position where the toothed segment disengages from the toothed gear wheel. The locked position is disposed behind the unlocked position in terms of a clockwise direction of the locking wheel. A cord-release controlling member includes a cord retaining region which engages a proximate cord segment of a pull cord with a holding friction force. In the unlocked position, by virtue of counteraction of the holding friction force against a biasing force of a coil spring of a spring motor, the cord retaining region is movable with the proximate cord segment of the pull cord along the running path. In the unlocked position, when a pulling force is exerted on a distal cord segment of the pull cord to pull the proximate cord segment against the biasing force of the coil spring, the proximate cord segment will move relative to the cord retaining region once the cord-release controlling member is prevented from moving away from the locking wheel. A guideway is disposed in the surrounding major wall, and includes a first route which extends angularly about the wheel axis from an initial region to an interval region such that the first route corresponds to movement of the toothed segment between the locked and unlocked positions, and a looped route which starts from and ends at the interval region, and which defines a pause region, and first and second turning regions. The first and second turning regions are disposed upstream and downstream of the pause region, respectively, and are spaced apart from the pause region. The first and second turning regions respectively correspond to first and second biased movements of the proximate cord segment of the pull cord with the cord retaining region which are caused by the biasing force when the toothed segment is in the unlocked position. The pause region corresponds to a pulled movement of said proximate cord segment relative to the cord retaining region against the biasing force. A guided member has a key end disposed to be guided along the guideway such that the key end cooperates with the wheel axis to define first, second, third, and fourth radii when in the first route, the first turning region, the pause region, and the second turning region, respectively. The first radius is longer than the second radius. The third radius is longer than the fourth radius but shorter than the second radius. The guided member further has a restricted end which is inserted into and which is slidable along a restricting groove in the housing. A linkage is disposed to couple the cord-release controlling member with the surrounding major wall such that when the cord-release controlling member is moved along the running path towards the locking wheel, the locking wheel is turned from the locked position to the unlocked position, and such that in the unlocked position, the cord retaining region remains unmoved in each of the first turning, pause and second turning regions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
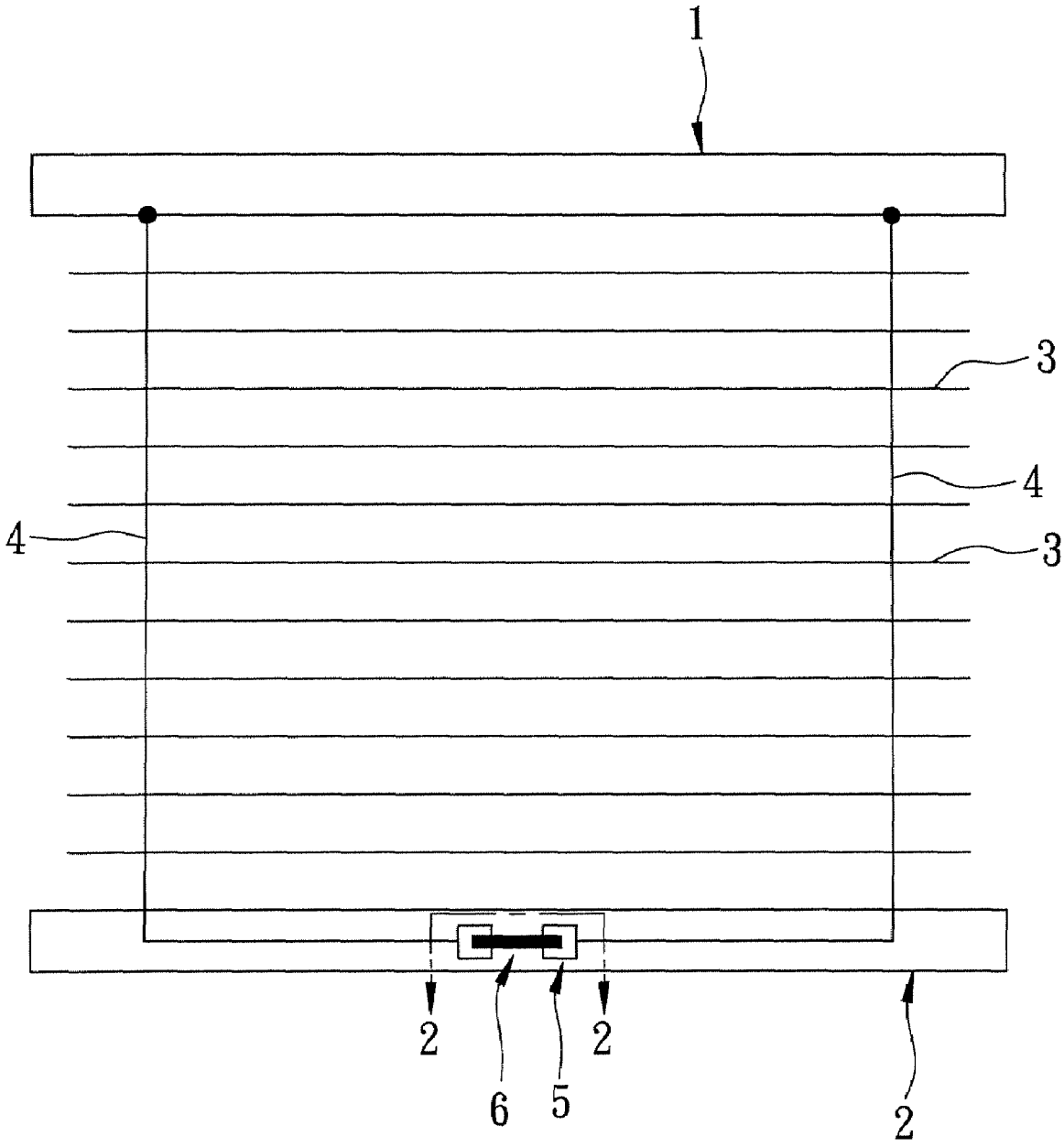
FIG. 1 PRIOR ART
FIG. 1 is a schematic front view of a conventional cordless blind.
Figure 2:
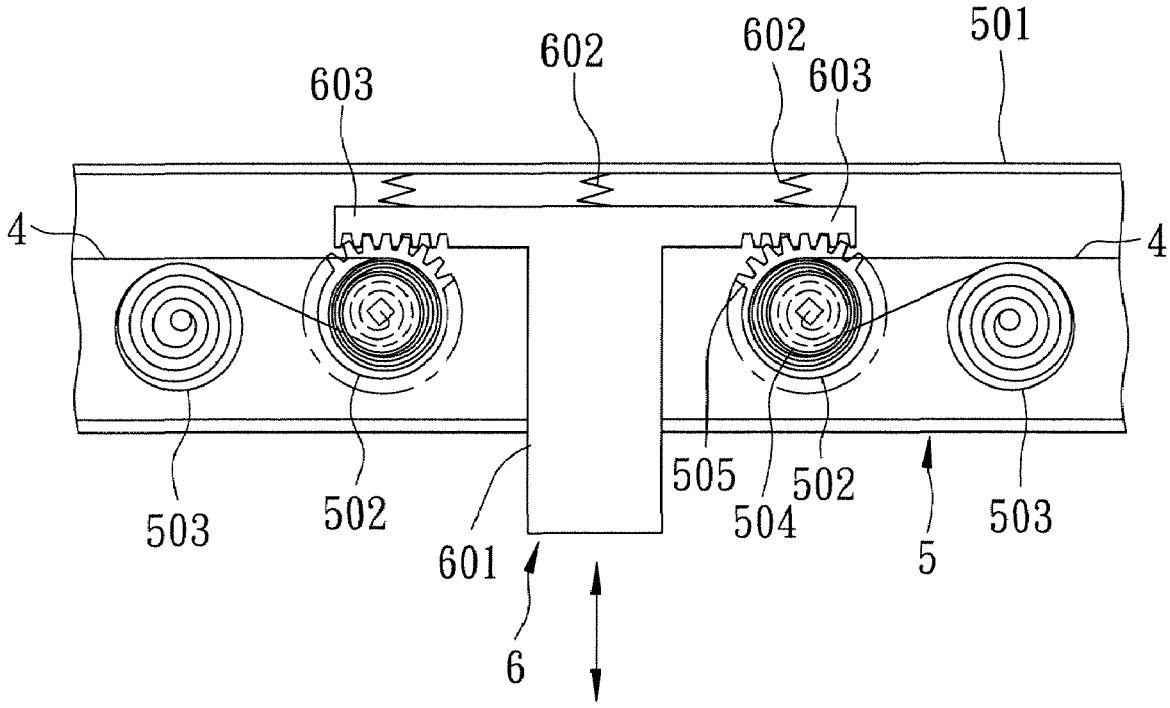
FIG. 2 PRIOR ART
FIG. 2 is a sectional view of the conventional cordless blind taken along lines 2-2 of FIG. 1.
Figure 3:
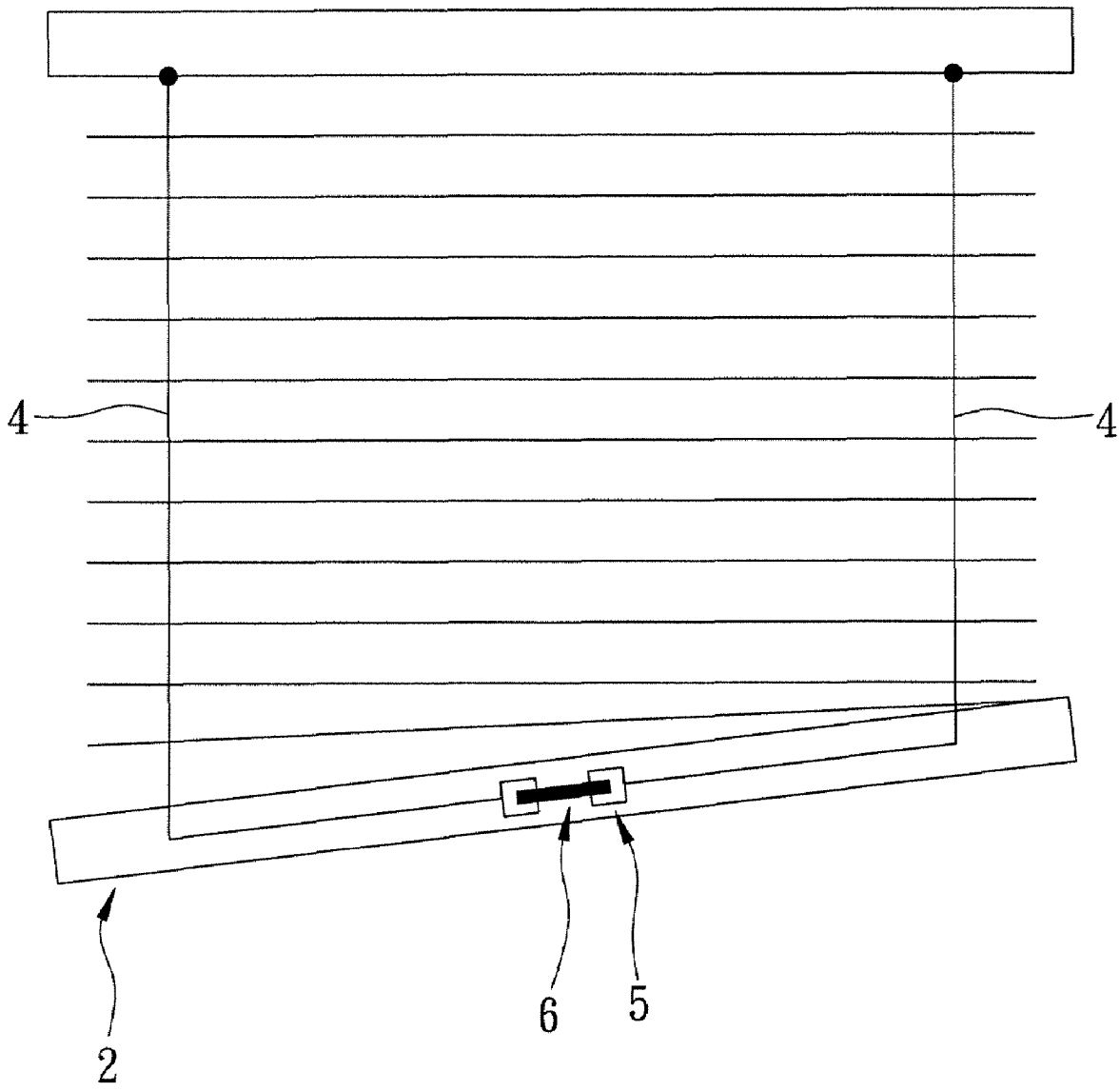
FIG. 3 PRIOR ART
FIG. 3 is a schematic front view of the conventional cordless blind in a slanting state.
Figure 4:
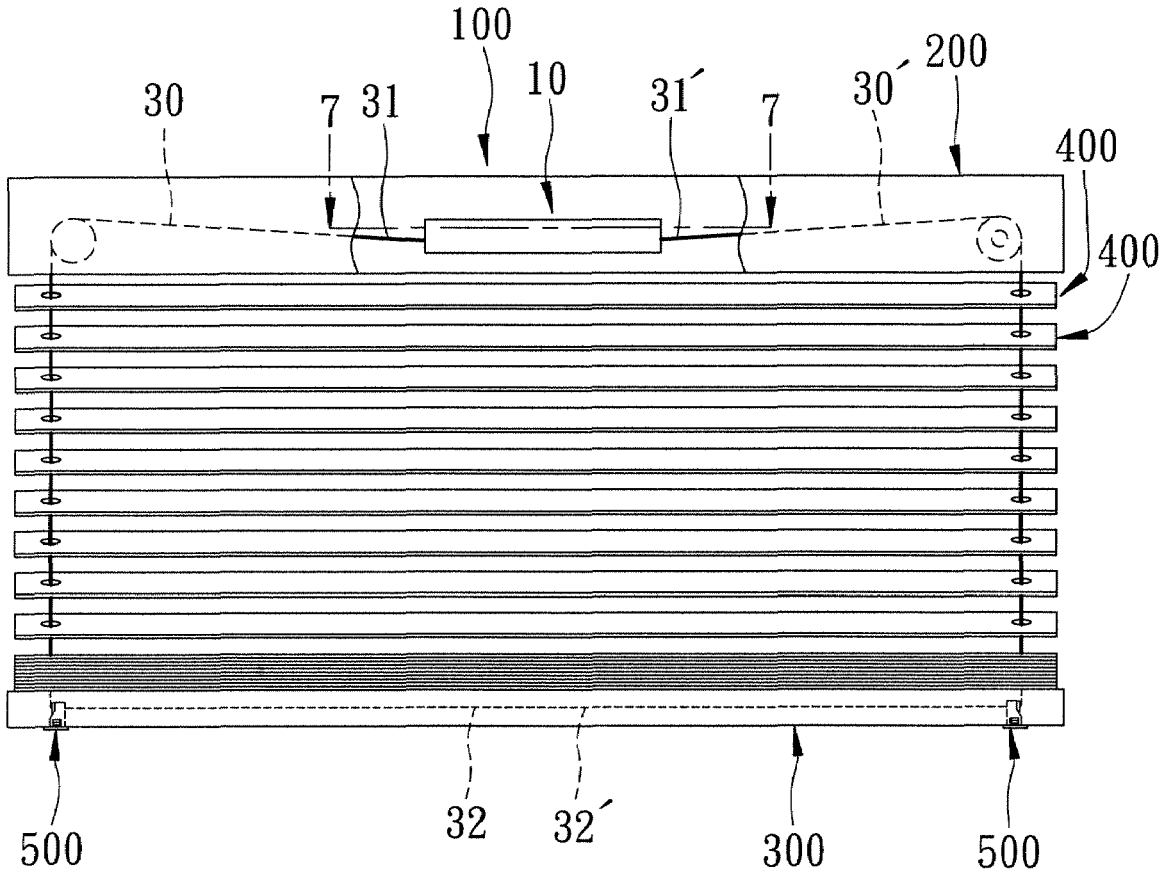
FIG. 4 is a schematic front view of the preferred embodiment of a window covering including a pull cord device according to this invention.
Figure 8:
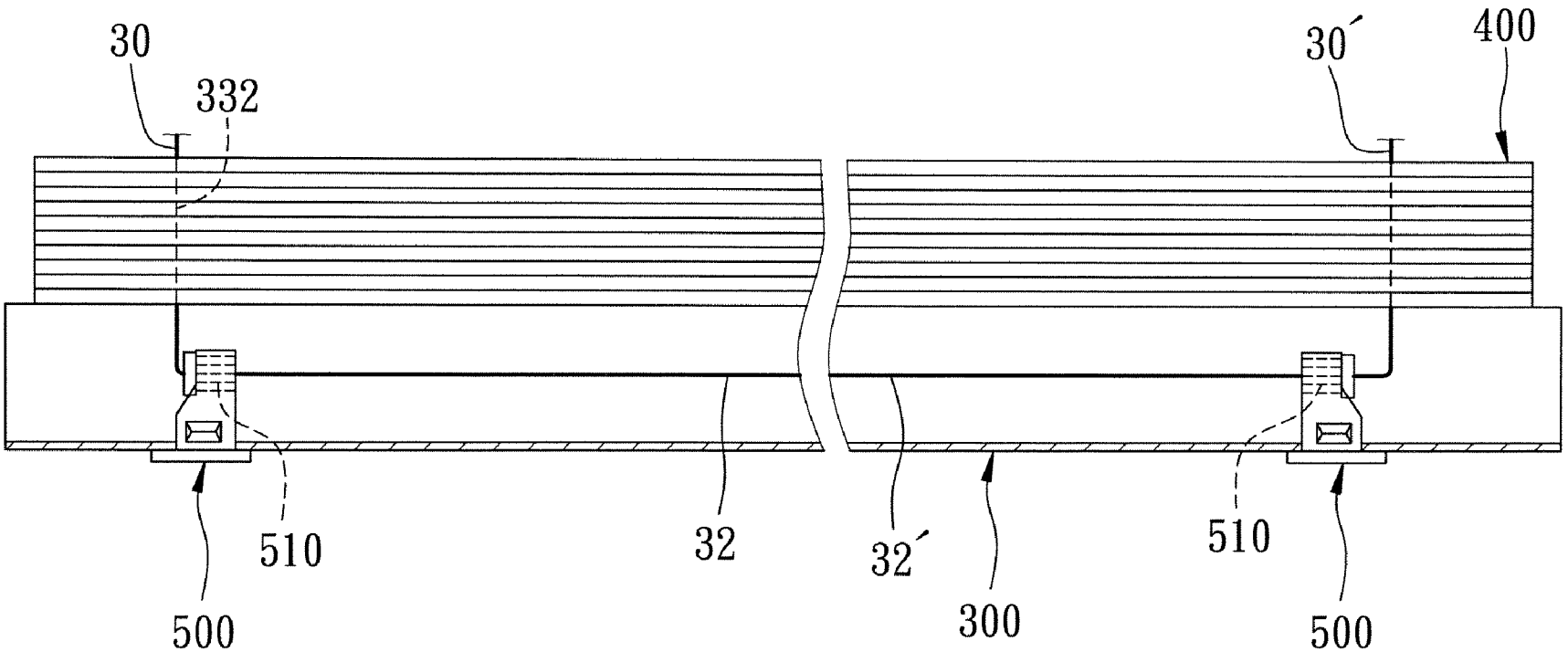
FIG. 8 is a fragmentary sectional view of a base rail of the window covering of the preferred embodiment.

FIG. 4 shows the preferred embodiment of a pull cord device for a window covering according to the present invention. As shown, the window covering, such as a Venetian blind, includes a header rail 200, a base rail 300 which is movable relative to the header rail 200 in an upright direction, a plurality of slats 400, two cord guiding members 500, and a cord assembly 100. Note that, for the sake of clarity, ladder strings for suspending the slats 400 as known in the art are not depicted. The cord guiding members 500 are disposed on the base rail 300, are spaced apart from each other in a longitudinal direction transverse to the upright direction, and respectively have guide holes 510, as shown in FIG. 8.

Figure 5:
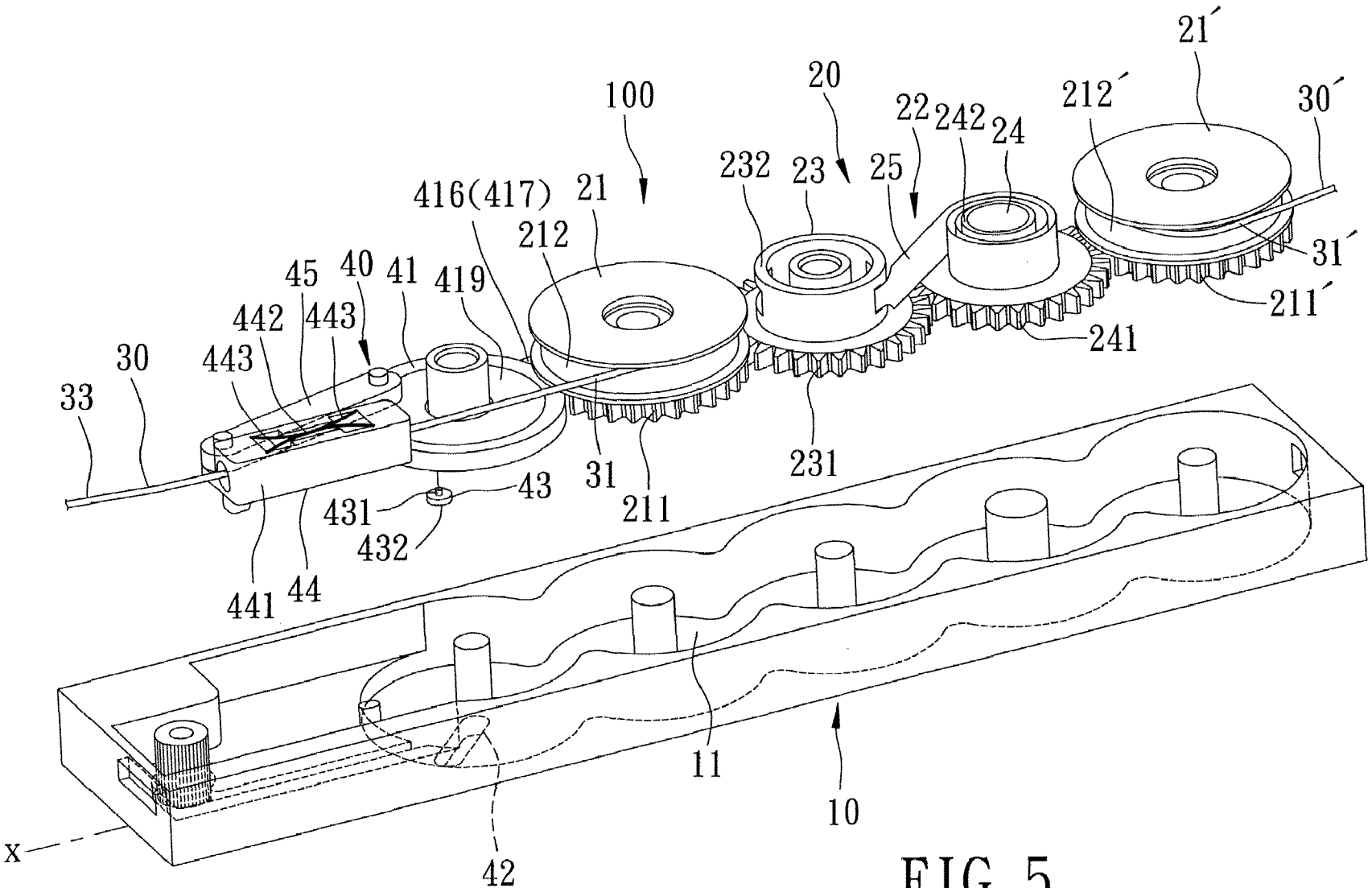
FIG. 5 is an exploded perspective view of the pull cord device of the preferred embodiment.
Figure 6:
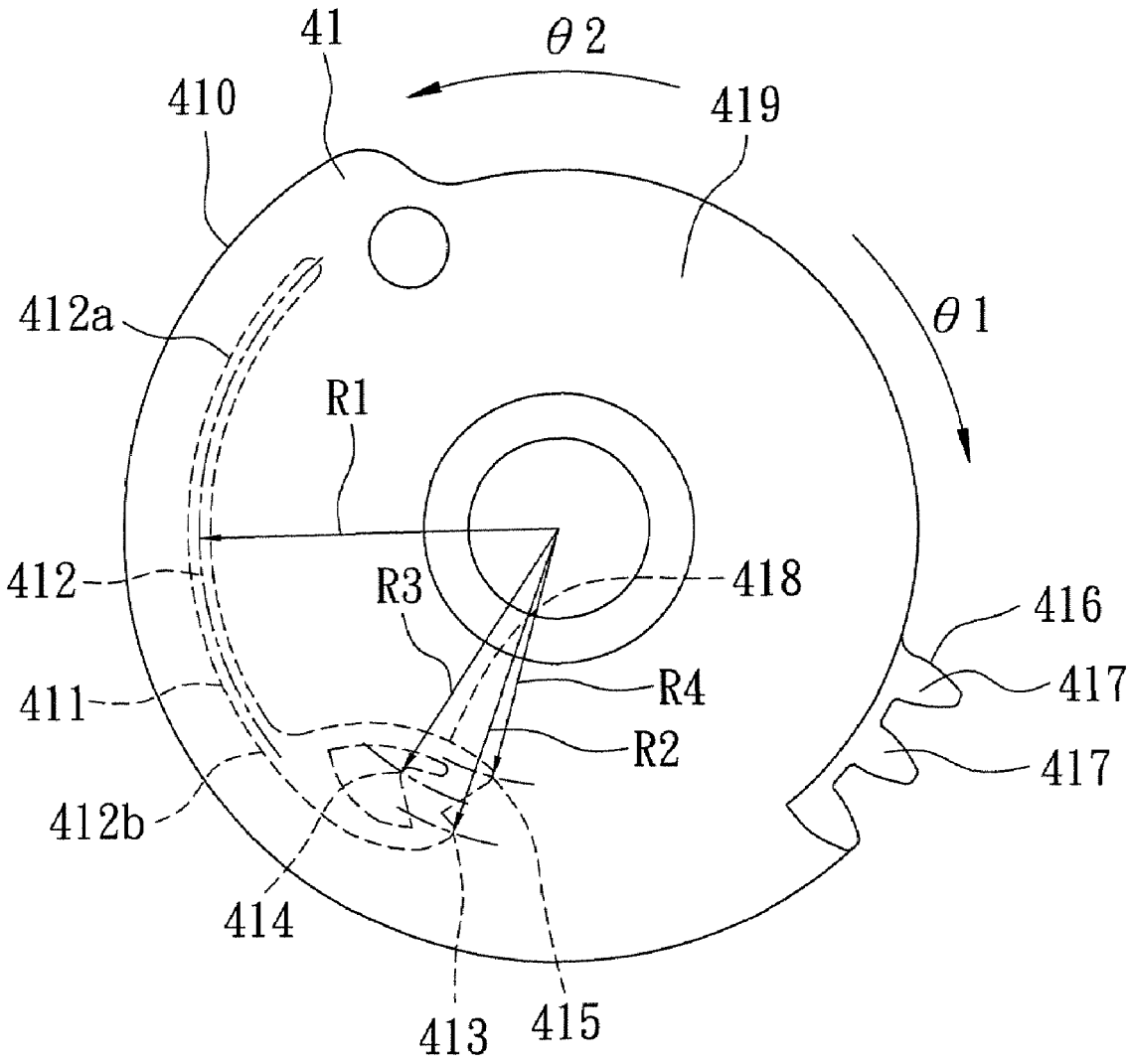
FIG. 6 is a top view of a locking wheel of the pull cord device of the preferred embodiment.
Figure 7:
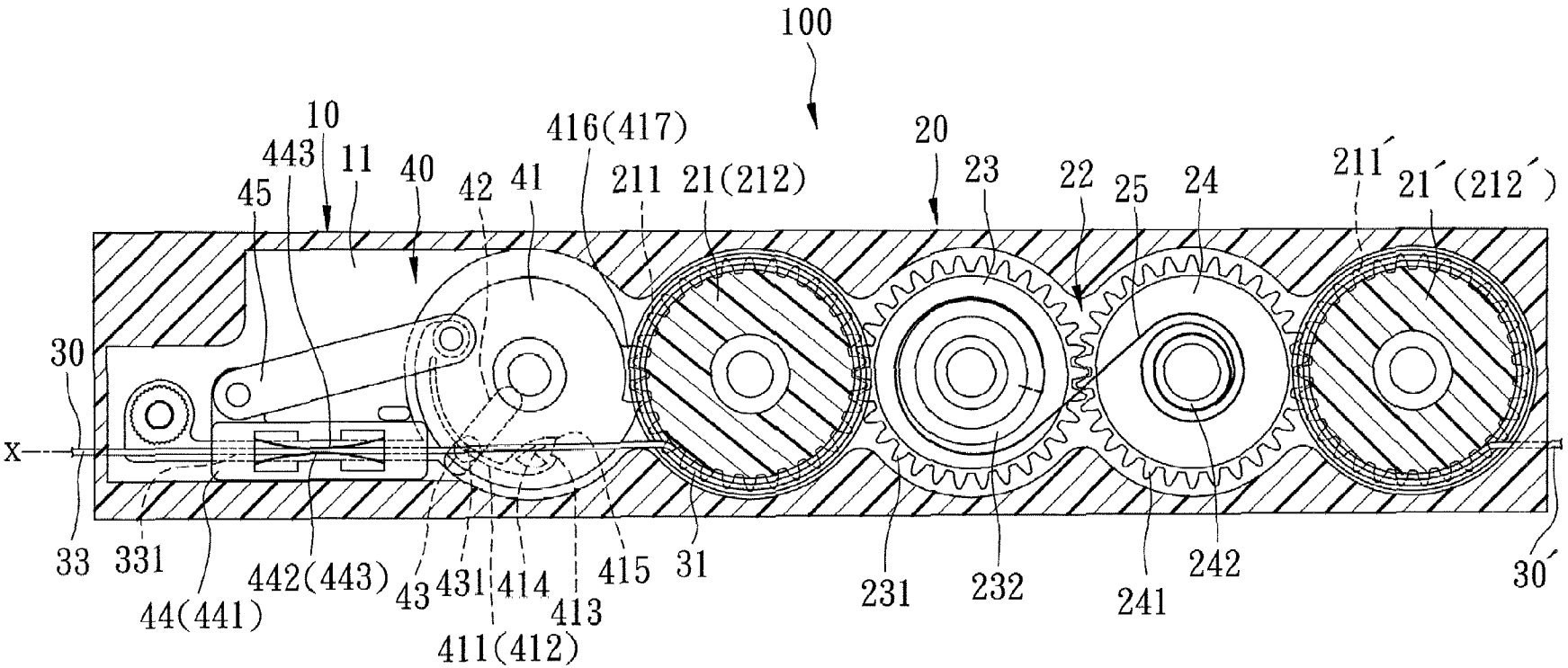
FIG. 7 is a sectional view of the pull cord device taken along lines 7-7 of FIG. 4, with a cord-release controlling member being in a first position.

With reference to FIGS. 5 to 7, the cord assembly 100 includes a housing 10, a spring driving unit 20, first and second pull cords 30, 30', and a braking unit 40.

The housing 10 is disposed on the header rail 200, and has a support wall 11 for supporting the spring driving unit 20 and the braking unit 40.

The spring driving unit 20 includes a spring motor 22 and first and second cord spools 21, 21'. The spring motor 22 includes a drive wheel 23, a take-up wheel 24, and a coil spring 25. The drive and take-up wheels 23, 24 respectively have a drive drum 232 and a take-up drum 242 which are rotatably mounted on the support wall 11 about winding axes in the upright direction such that the coil spring 25 is wound on the drive and take-up drums 232, 242, and has a biasing force to bias the drive and take-up wheels 23, 24 to rotate clockwise and counterclockwise about the winding axes, respectively, and gear portions 231, 241 which mesh with each other to rotate the drive and take-up wheels 23, 24 synchronously.

The first and second cord spools 21, 21' can rotate about first and second rotating axes parallel to the winding axis, and respectively have first and second spool hubs 212, 212' surrounding the first and second rotating axes, and first and second toothed gear wheels 211,211' which are disposed radially and outwardly of the first and second spool hubs 212,212' relative to the first and second rotating axes, and which mesh with the gear portions 231,241 of the drive and take-up wheels 23, 24, respectively, so as to be biased by the coil spring 25 to rotate counterclockwise and clockwise, respectively.

The first and second pull cords 30,30' respectively have a leading cord end 31 and a first cord end 31' which are coupled with the first and second spool hubs 212,212' respectively, so as to permit the first and second pull cords 30,30' to be wound thereon, respectively, and a tailing cord end 32 and a second cord end 32' (see FIG. 4) which are opposite to the leading cord end 31 and the first cord end 31', respectively, and which are connected to the base rail 300. As shown in FIG. 8, the tailing cord end 32 and the second cord end 32' extend to pass through the guiding holes 510 in the cord guiding members 500 to be connected to each other such that movement of the first and second pull cords 30,30' can be guided by the cord guiding members 500. Referring to FIGS. 7 and 8, the first pull cord 30 further has a cord body 33 which is interposed between the leading and tailing cord ends 31, 32, and which includes proximate and distal cord segments 331, 332 relative to the leading cord end 31. The proximate cord segment 331 is disposed such that when the leading cord end 31 is being reeled on or off the first spool hub 212, the proximate cord segment 331 moves along a running path (x) in the longitudinal direction to be described in detail hereinafter.

The braking unit 40 includes a locking wheel 41 which is rotatable relative to the support wall 11 about a wheel axis parallel to the winding axis, a restricting groove 42 which is formed in the support wall 11 and which extends in a direction radial to the wheel axis, a guided member 43 which has a restricted end 432 inserted into and slidable along the restricting groove 42 and a key end 431 opposite to the restricted end 432, a cord-release controlling member 44, and a linkage 45.

With reference to FIGS. 6 and 7, the locking wheel 41 is disposed to confront the restricting groove 42, and includes a rim 410 surrounding the wheel axis, a surrounding major wall 419 extending from the rim 410 in radial directions and towards the wheel axis, and a toothed segment 416 having a plurality of teeth 417 and disposed on the rim 410. With the rotation of the locking wheel 41 about the wheel axis, the toothed segment 416 is turnable between a locked position where the toothed segment 416 engages the toothed gear wheel 211 of the first cord spool 21, and an unlocked position where the toothed segment 416 disengages from the toothed gear wheel 211. The locked position is disposed behind the unlocked position in terms of a clockwise direction (θ1) of the locking wheel 41. A guideway 411 is disposed in the surrounding major wall 419 for guiding movement of the key end 431 of the guided member 43 therealong. The configuration of the guideway 411 will be described in detail hereinafter.

The cord-release controlling member 44 includes a sliding piece 441 which is slidable along the running path (x), and two leaf springs 443 which are mounted on the sliding piece 441, which cooperatively serve as a cord retaining region 442, and which are spaced apart from each other in a direction transverse to the running path (x) so as to clamp the proximate cord segment 331 therebetween with a holding friction force. With such an arrangement of the leaf springs 443 and the proximate cord segment 331, when the locking wheel 41 is in the unlocked position, by virtue of the counteraction of the holding friction force against the biasing force, the cord retaining region 442 is movable with the proximate cord segment 331 along the running path (x). Also, when the locking wheel 41 is in the unlocked position, and a pulling force is exerted on the distal cord segment 332 to pull the proximate cord segment 331 against the biasing force, the proximate cord segment 331 is movable relative to the cord retaining region 442 once the cord-release controlling member 44 is prevented from moving away from the locking wheel 41 to be described in detail hereinafter.

The linkage 45 is pivotally connected to the sliding piece 441 and the surrounding major wall 419 of the locking wheel 41 so as to turn the locking wheel 41 in a clockwise or counterclockwise direction (θ1,θ2) when the cord-release controlling member 44 is moved along the running path (x). For example, when the cord-release controlling member 44 is moved towards the locking wheel 41, the locking wheel 41 is turned from the locked position to the unlocked position.

Referring to FIG. 6, the guideway 411 includes a first route 412 and a looped route 418. The first route 412 extends angularly about the wheel axis from an initial region (412*a*) to an interval region (412*b*) such that the first route 412 corresponds to the movement of the toothed segment 416 between the locked and unlocked positions. The looped route 418 starts from and ends at the interval region (412*b*), and defines a pause region 414, and first and second turning regions 413, 415 which are disposed upstream and downstream of the pause region 414 respectively, and which are spaced apart from the pause region 414 in the longitudinal direction. The first and second turning regions 413, 415 respectively correspond to first and second biased movements of the proximate cord segment 331 with the cord retaining region 442 which are caused by the biasing force when the locking wheel 41 is in the unlocked position. The pause region 414 corresponds to a pulled movement of said proximate cord segment 331 relative to said cord retaining region 442 against the biasing force. Specifically, the key end 431 of the guided member 43 cooperates with the wheel axis of the locking wheel 41 to define first, second, third, and fourth radii (R1, R2, R3, R4), when in the first route 412, the first turning region 413, the pause region 414, and the second turning region 415, respectively. The first radius (R1) is longer than the second radius (R2). The third radius (R3) is longer than the fourth radius (R4) but shorter than the second radius (R2).

It is noted that the linkage 45 is provided such that when the locking wheel 41 is in the unlocked position, the cord retaining region 442 remains unmoved in each of the first turning, pause and second turning regions. Moreover, the restricted end 432 of the guided member 43 can facilitate smooth movement of the key end 431 in the guideway 411 when the locking wheel 41 is in the unlocked position.

FIG. 7 shows the cord assembly 100 in a state when the locking wheel 41 is in the locked position, and when the cord-release controlling member 44 is in a first position where the key end 431 is in the first route 412. Thus, the first and second cord spools 21, 21' and the drive and take-up wheels 23, 24 are blocked so as to maintain the base rail 300 at a height level.

Figure 9:
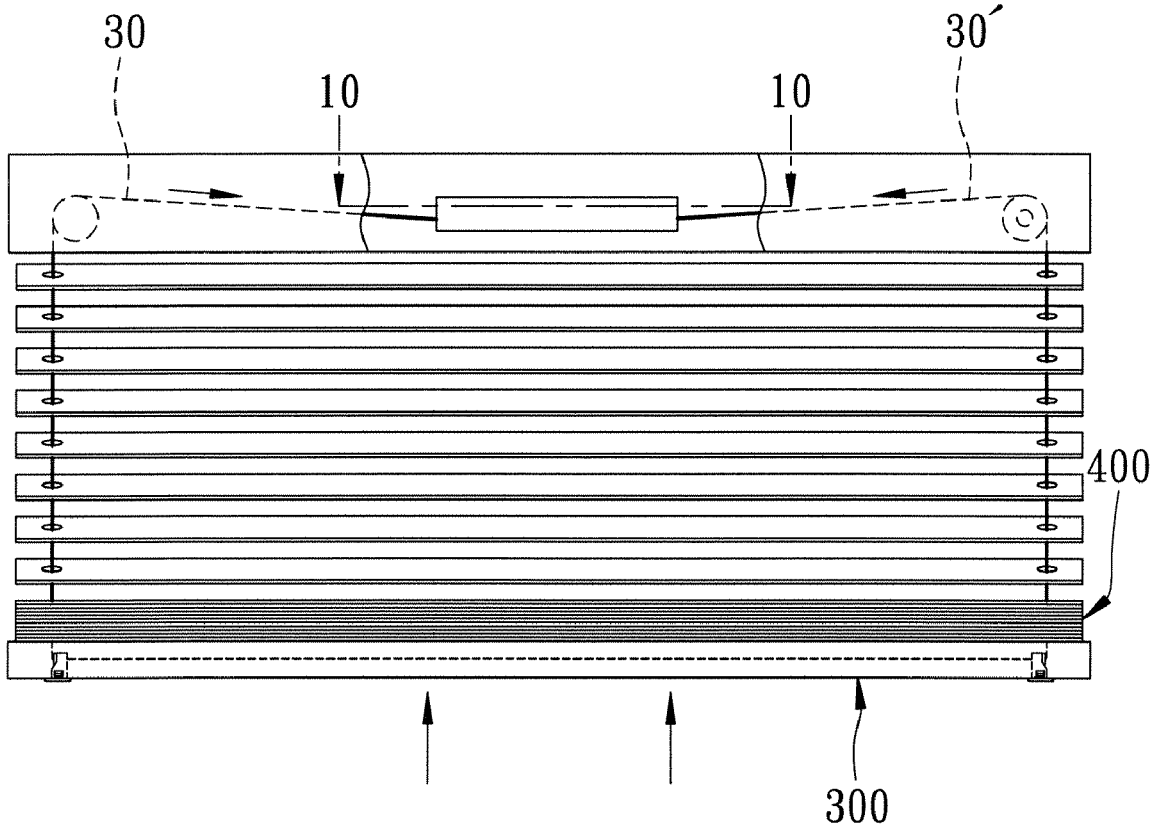
FIG. 9 is a view similar to FIG. 4, showing that the base rail is pushed slightly upward.
Figure 10:
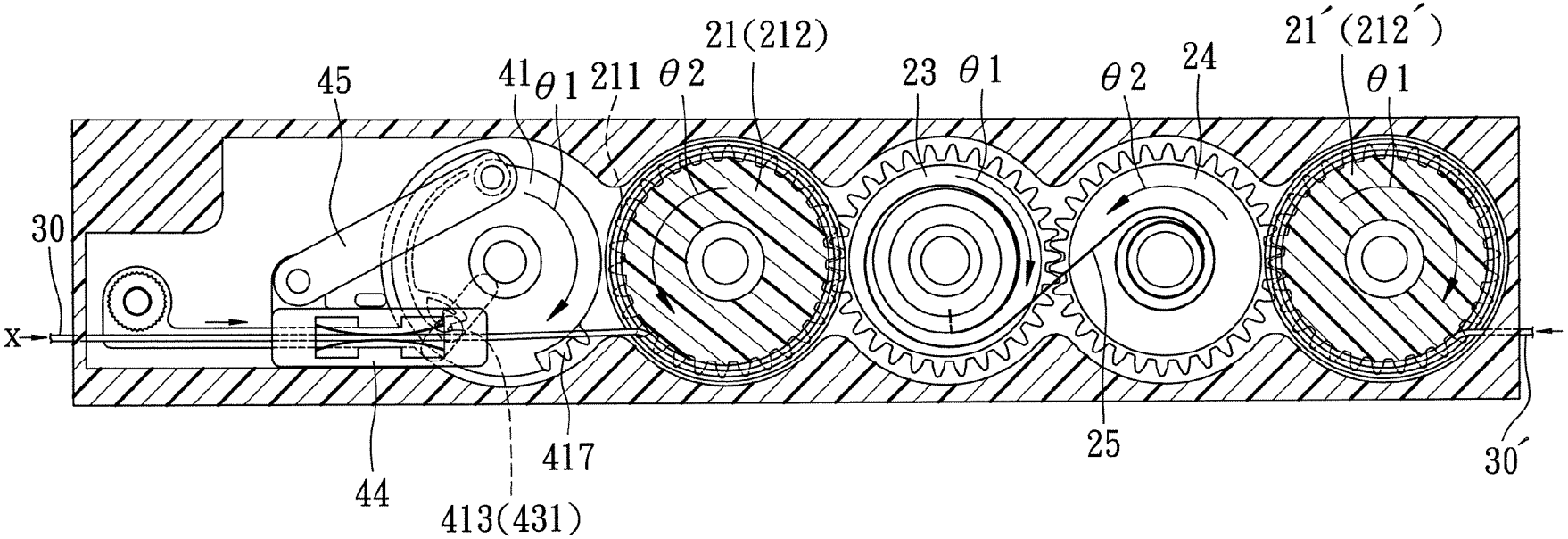
FIG. 10 is a sectional view of the pull cord device taken along lines 10-10 of FIG. 9, with a cord-release controlling member being in a second position.

In operation, when it is desired to pull the base rail 300 to a lowermost position for spreading all the slats 400, referring to FIGS. 9 and 10, the user slightly pushes the base rail 300 upwards with both hands to counteract the combined weights of the base rail 300 and the slats 400, and to cause the drive wheel 23 to be rotated in the clockwise direction (θ1) by the biasing action of the coil spring 25 so that the first cord spool 21 and the take-up wheel 24 are rotated in the counterclockwise direction (θ2), and the second cord spool 21' is rotated in the clockwise direction (θ1). Thus, the first and second pull cords 30, 30' are reeled on the first and second spool hubs 212, 212'. With the movement of the proximate cord segment 331 (i.e. the first biased movement of the proximate cord segment 331), the cord retaining region 442 is moved along the running path (x) toward the locking wheel 41 from the first position (as shown in FIG. 7) to a second position, where the locking wheel 41 is rotated by means of the linkage 45 in the clockwise direction (θ1) from the locked position to the unlocked position, until the key end 431 reaches the first turning region 413 so as to immobilize the cord-release controlling member 44.

Figure 11:
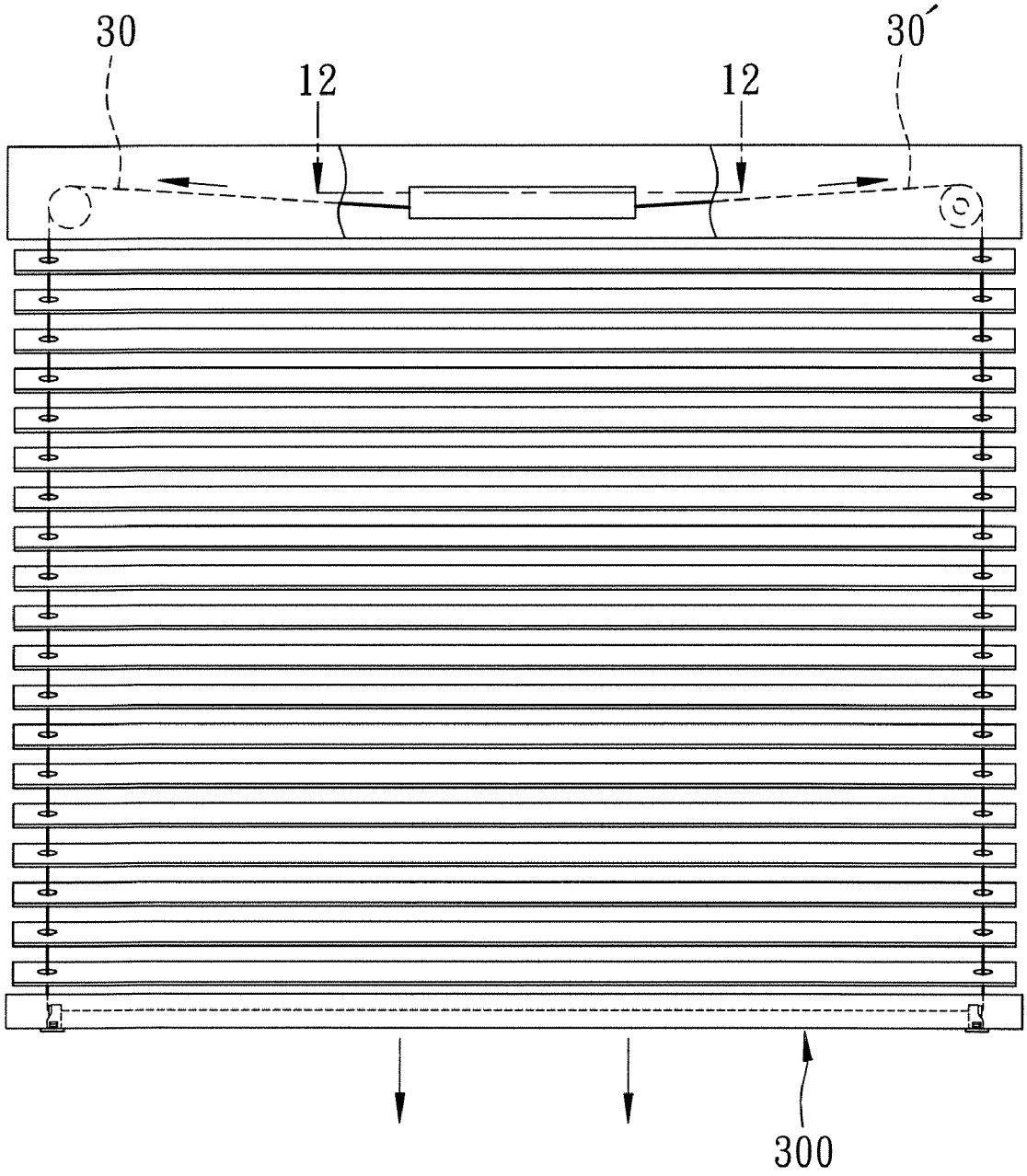
FIG. 11 is a view similar to FIG. 4, showing that the base rail is pulled to a lowermost position.
Figure 12:
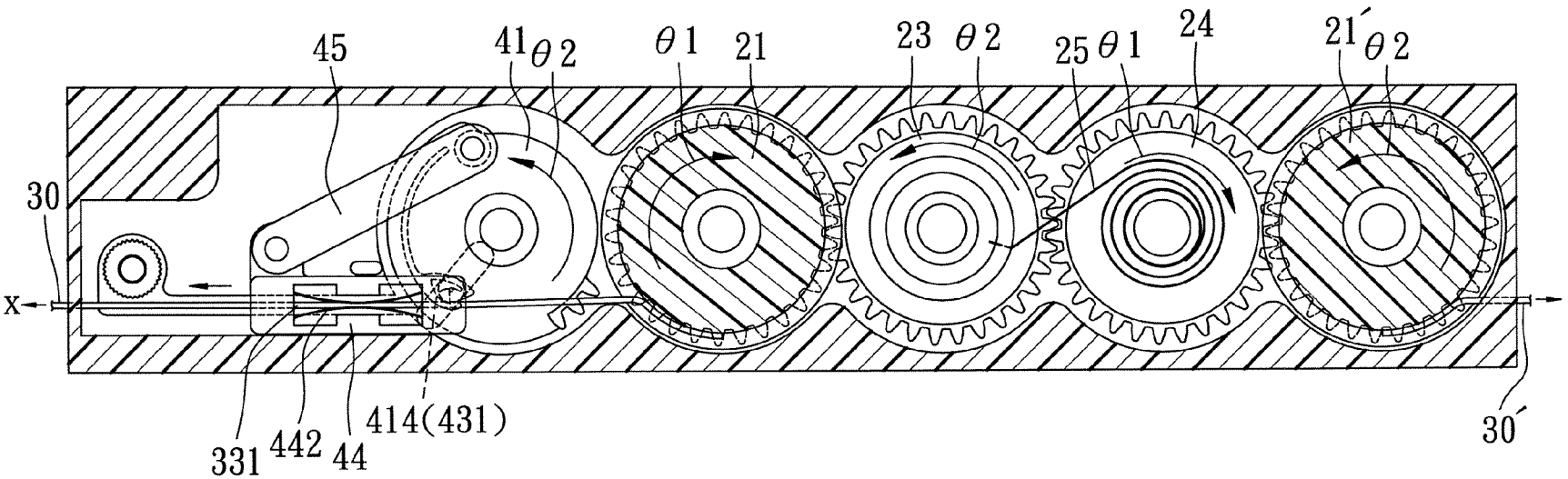
FIG. 12 is a sectional view of the pull cord device taken along lines 12-12 of FIG. 11, with a cord-release controlling member being in a third position.

Subsequently, referring to FIGS. 11 and 12, the user can pull the base rail 300 to the lowermost position. During the pulling operation, the first and second pull cords 30, 30' are pulled outwardly from the first and second cord spools 21, 21' so that the first and second cord spools 21, 21' rotate in the clockwise and counterclockwise directions (θ1,θ2), respectively, and the drive and take-up wheels 23, 24 rotate in the counterclockwise and clockwise directions (θ2,θ1), respectively, to wind the coil spring 25 on the take-up wheel 24. Consequently, the cord retaining region 442 is moved with the proximate cord segment 331 (i.e. the pulled movement of the proximate cord segment 331) along the running path (x) away from the locking wheel 41 from the second position (as shown in FIG. 10) to a third position, where the locking wheel 41 is rotated by means of the linkage 45 in the counterclockwise direction (θ2) until the key end 431 reaches the pause region 414 so as to prevent movement of the cord-release controlling member 44.

Figure 13:
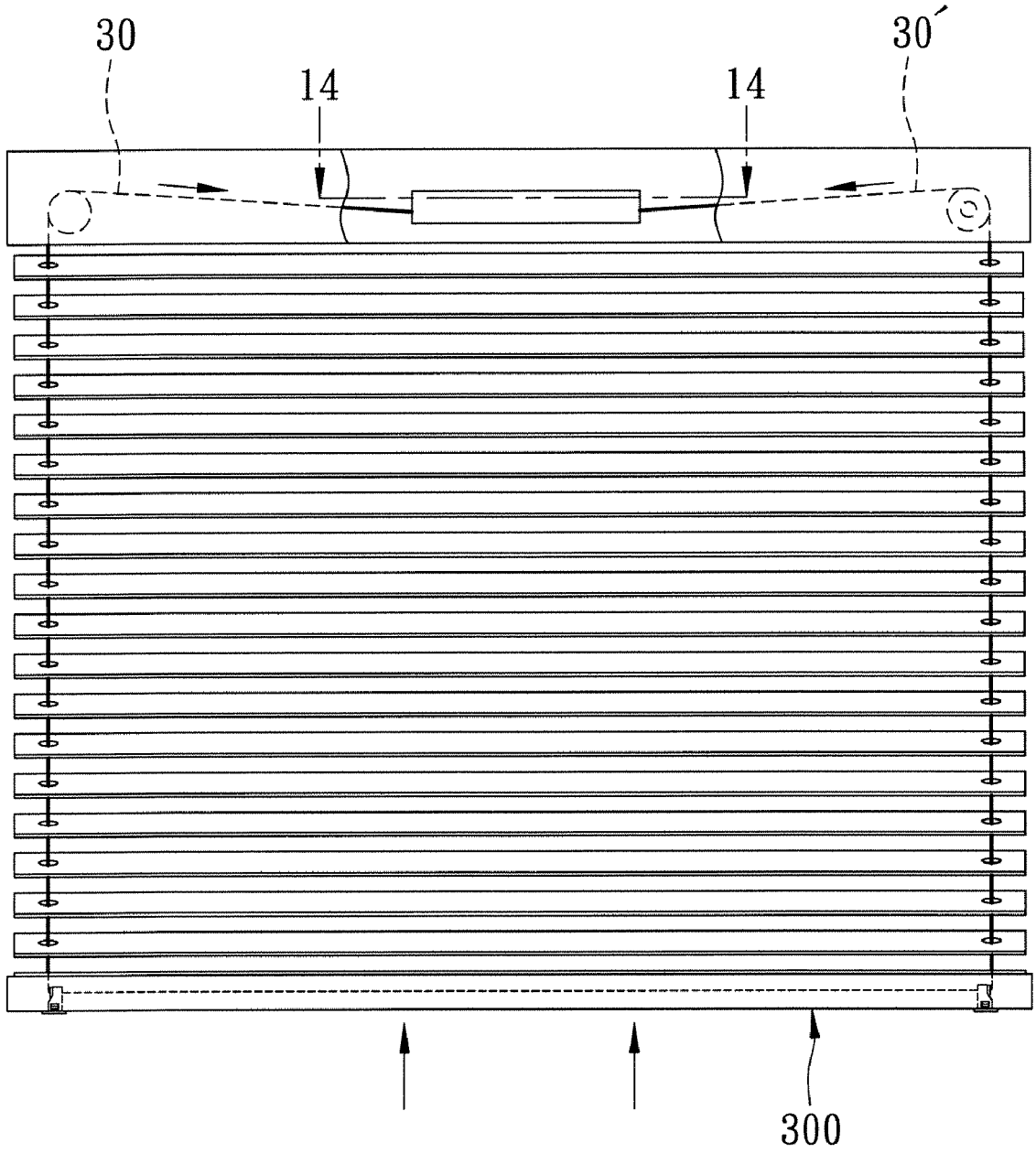
FIG. 13 is a view similar to FIG. 11, showing that the base rail is pushed slightly upward.
Figure 14:
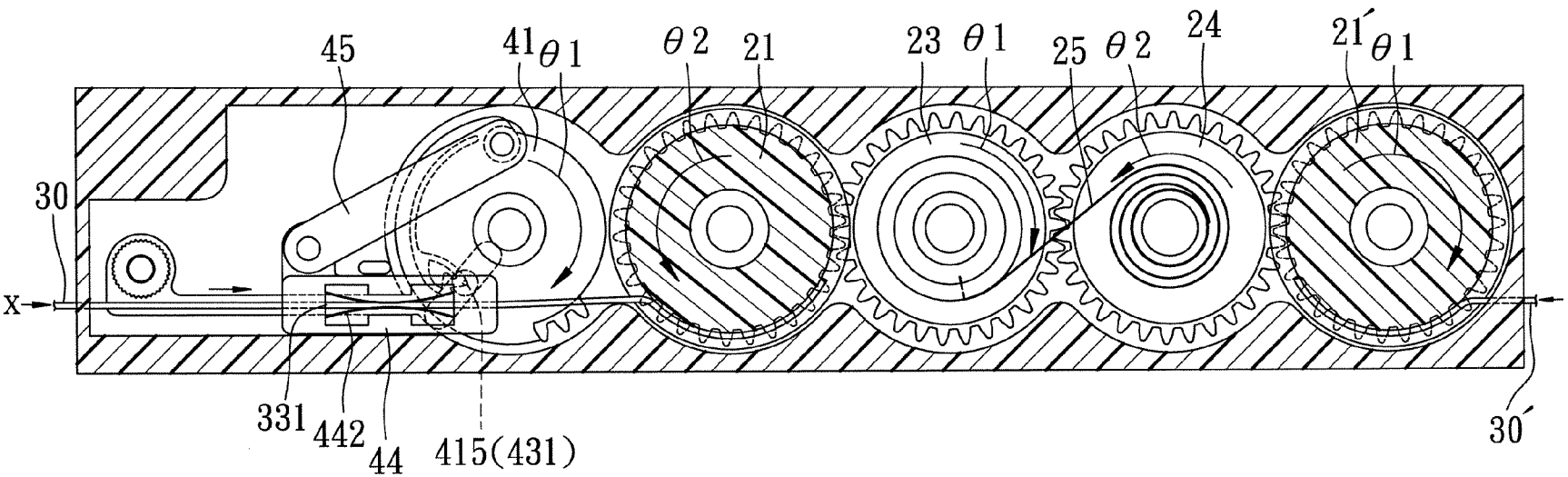
FIG. 14 is a sectional view of the pull cord device taken along lines 14-14 of FIG. 13, with a cord-release controlling member being in a fourth position.

Thereafter, referring to FIGS. 13 and 14, the user can slightly push the base rail 300 upwards with both hands to actuate the drive wheel 23 to rotate in the clockwise direction (θ1) through the biasing action of the coil spring 25 so that the first and second cord spools 21, 21' are rotated in the counterclockwise and clockwise direction (θ2,θ1), respectively. Thus, the first and second pull cords 30, 30' are reeled on the first and second spool hubs 212, 212'. With the movement of the proximate cord segment 331 (i.e. the second biased movement of the proximate cord segment 331), the cord retaining region 442 is moved along the running path (x) toward the locking wheel 41 from the third position (as shown in FIG. 12) to a fourth position, where the locking wheel 41 is rotated by means of the linkage 45 in the clockwise direction (θ1)

until the key end 431 reaches the second turning region 415 so as to immobilize the cord-release controlling member 44.

Figure 15:
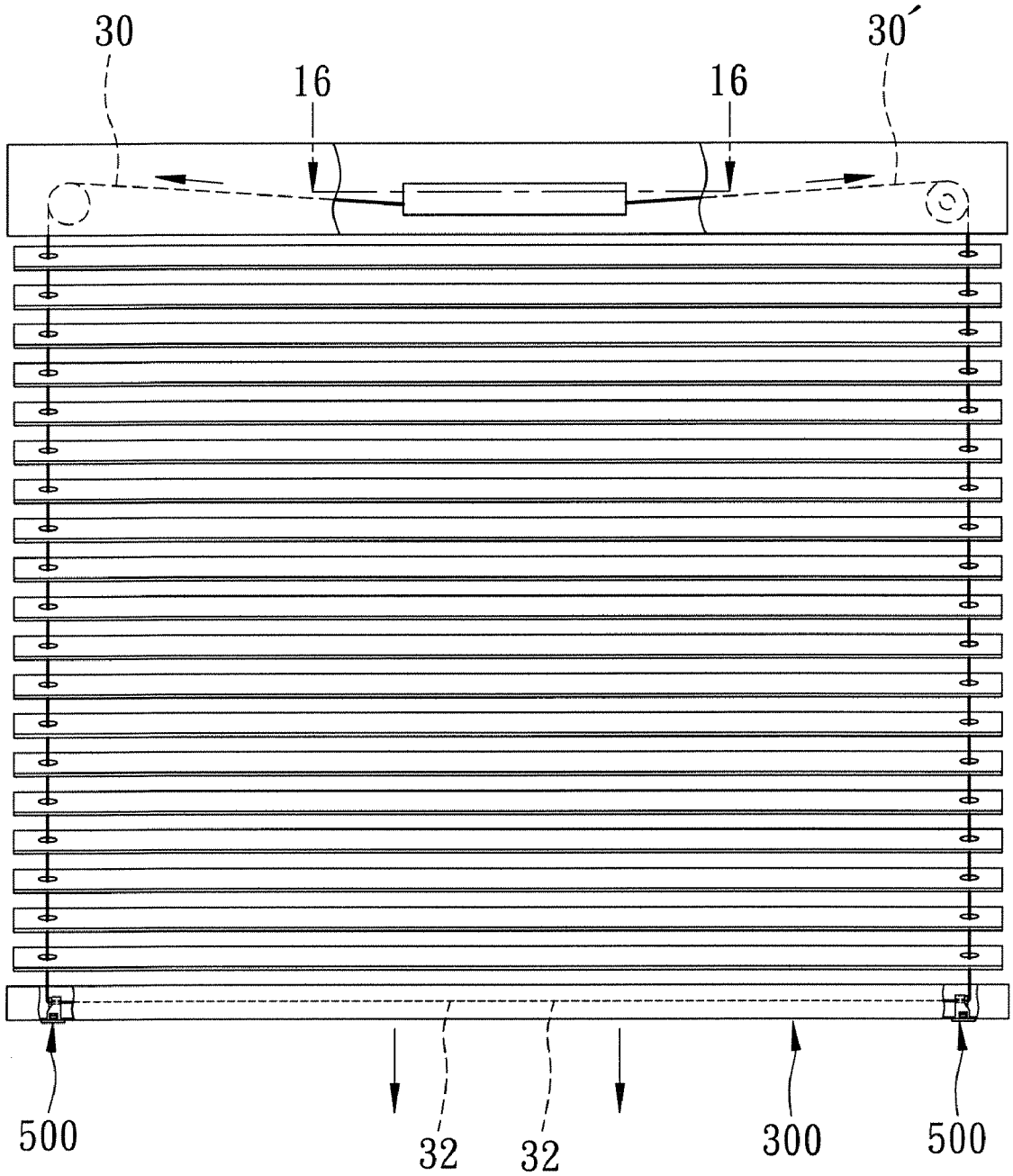
FIG. 15 is a view similar to FIG. 11, showing that the base rail is pulled slightly downward.
Figure 16:
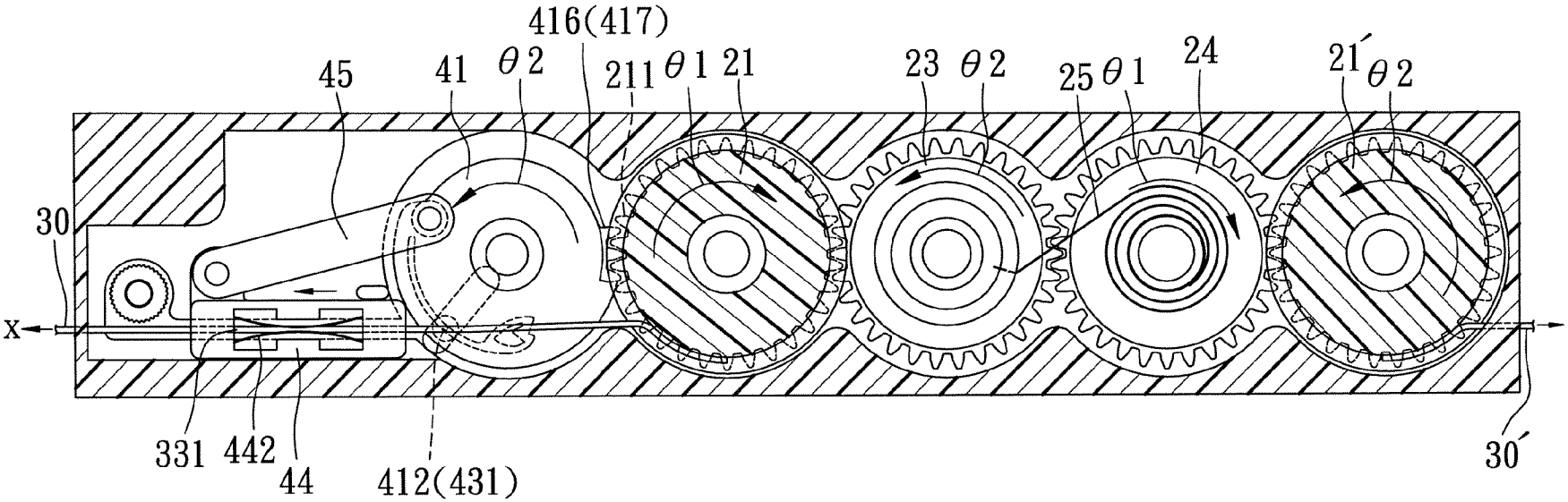
FIG. 16 is a sectional view of the pull cord device taken along lines 16-16 of FIG. 15, with a cord-release controlling member being returned to the first position.

Finally, referring to FIGS. 15 and 16, the user can slightly pull the base rail 300 downward. During this operation, the first and second pull cords 30, 30' are pulled from the first and second cord spools 21, 21' so that the first and second cord spools 21, 21' rotate in the clockwise and counterclockwise directions (θ1,θ2), respectively, and the drive and take-up wheels 23, 24 rotate in the counterclockwise and clockwise directions (θ2,θ1), respectively. In addition, the cord retaining region 442 is moved with the proximate cord segment 331 along the running path (x) away from the locking wheel 41 from the fourth position (as shown in FIG. 14) to the first position, where the locking wheel 41 is rotated by means of the linkage 45 in the counterclockwise direction (θ2) until the key end 431 reaches the first route 412, and the teeth 417 of the toothed segment 416 mesh with the toothed gear wheel 211 of the first cord spool 21 to bring the locking wheel 41 into the locked position. Thus, the base rail 300 is locked at the lowermost position.

As illustrated, by manipulating the base rail 300 in the manner as described above, the user can position the base rail 300 at a desired height with ease. In a similar manner, for example, the user can slightly push and pull the base rail 300 upwards and downwards, then pushes the base rail 300 upwards to a desired height position, and then slightly pulls the base rail 300 downwards to thereby lock the base rail 300 in the desired height position.

Figure 17:
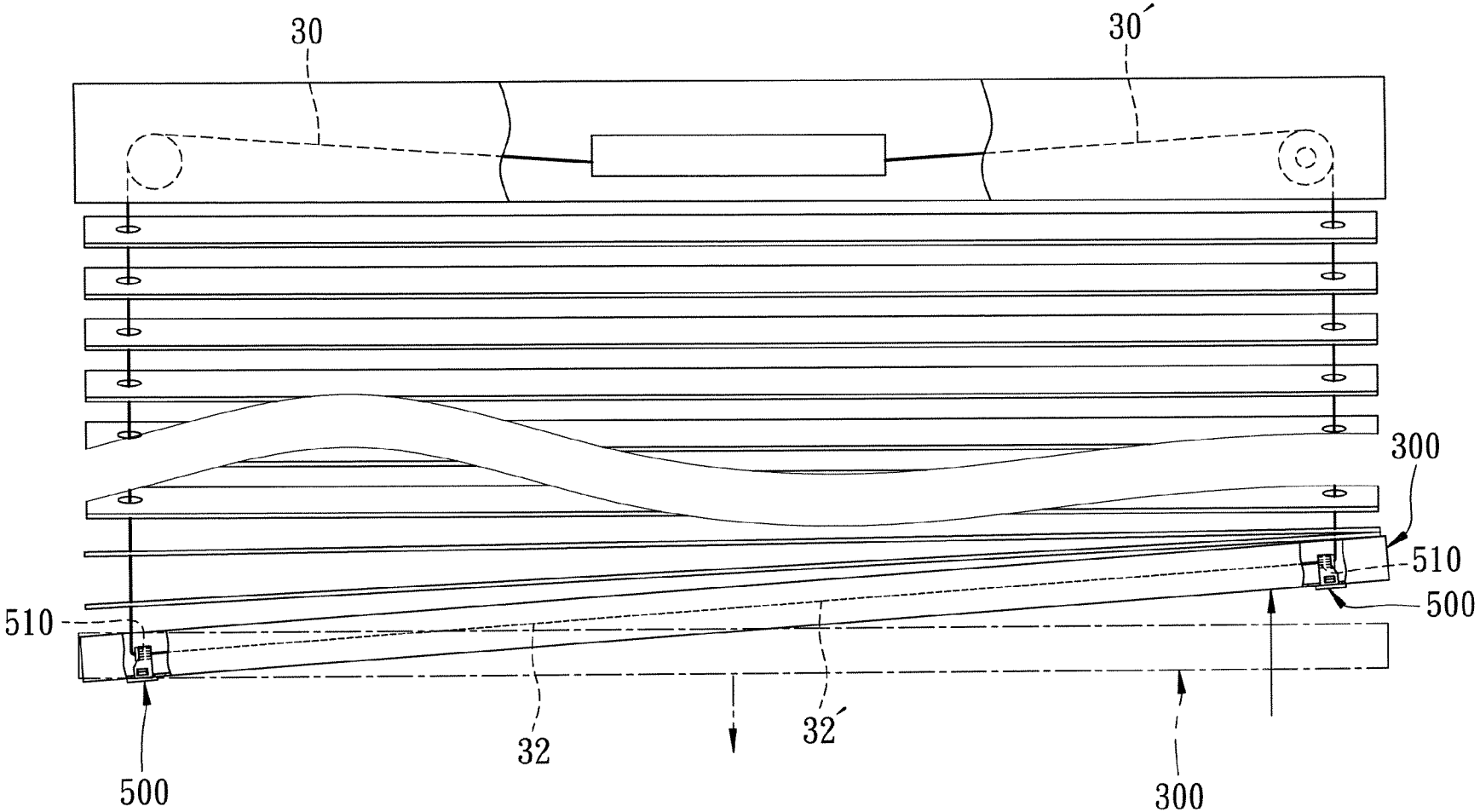
FIG. 17 is a view similar to FIG. 15, showing how the base rail is adjusted from a slanting state to a horizontal state.

Moreover, as shown in FIG. 17, when the base rail 300 is slanted to one side inadvertently, since the first and second pull cords 30, 30' extend through the guiding holes 510 in the cord guiding members 500 to be connected to each other so that the base rail 300 can be moved relative to the pull cords 30, 30' through the guiding holes 510, the user can push the lower portion of the base rail 300 upwards so that the base rail 300 can move relative to the respective pull cord 30, 30' by virtue of its own weight to a horizontal state as shown in FIG. 15.

Accordingly, the pull cord device of this invention has the following advantages:

1. Since the base rail 300 can be moved and positioned by pushing and pulling the same to control rotation of the cord spools 21, 21' and the wheels 23, 24, the coil spring 25 is configured to have a biasing force sufficient to reel the pull cords 30, 30' on the cord spools 21, 21'. Thus, the cord assembly 100 of this invention is suitable for window coverings of varying dimensions without the need to replace or renew the coil spring 25.

2. Since the user can push and pull the base rail 300 with both hands during operation, the operation is relatively convenient compared with the prior art. Besides, slanting of the base rail 300 can be avoided.

3. If the base rail 300 slants to one side, the user can push the lower portion of the base rail 300 upwards and then allow the lower portion to fall downwardly by gravity to thereby bring the base rail 300 to a horizontal state. Thus, adjustment of the position of the base rail 300 is easy and convenient to conduct.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A pull cord device adapted to control raising and lowering of a base rail relative to a header rail of a window covering in an upright direction, said pull cord device comprising:

a housing which is adapted to be disposed on one of the base rail and the header rail, and which has a restricting groove disposed therein;

a spring motor which is disposed in said housing, and which has a coil spring that has a biasing force and that is wound about a winding axis;

a cord spool which is disposed in said housing to rotate about a rotating axis that is parallel to the winding axis, which has a spool hub surrounding the rotating axis and a toothed gear wheel that is disposed radially and outwardly of said spool hub relative to the rotating axis, and which is configured to be biased by the biasing force of said coil spring to rotate;

a pull cord having a leading cord end which is coupled with said spool hub so as to permit said pull cord to be wound thereon, a tailing cord end which is opposite to said leading cord end, and which is adapted to be connected to the other one of the base rail and the header rail, and a cord body which is interposed between said leading cord end and said tailing cord end, and which includes proximate and distal cord segments relative to said leading cord end, said proximate cord segment being disposed such that when said leading cord end is being reeled on or off of said spool hub, said proximate cord segment moves along a running path in a longitudinal direction that is transverse to the upright direction;

a locking wheel mounted in and rotatable relative to said housing about a wheel axis parallel to the winding axis, and including a rim surrounding the wheel axis, a surrounding major wall extending from said rim in radial directions and towards the wheel axis, and a toothed segment which is disposed on said rim, and which is turnable between a locked position where said toothed segment engages said toothed gear wheel, and an unlocked position where said toothed segment disengage from said toothed gear wheel, the locked position being disposed behind the unlocked position in terms of a rotating direction of said locking wheel;

a cord-release controlling member including a cord retaining region which engages said proximate cord segment with a holding friction force such that, when said toothed segment is in the unlocked position, said cord retaining region is movable with said proximate cord segment along the running path by virtue of counteraction of the holding friction force against the biasing force, and such that, when a pulling force is exerted on said distal cord segment to pull said proximate cord segment against the biasing force in the unlocked position, said proximate cord segment is movable relative to said cord retaining region once said cord-release controlling member is prevented from moving away from said locking wheel;

a guideway disposed in said surrounding major wall, and including a first route which extends angularly about the wheel axis from an initial region to an interval region such that said first route corresponds to movement of said toothed segment between the locked and unlocked positions, and a looped route starting from and ending at said interval region, and defining a pause region, and first and second turning regions which are disposed upstream and downstream of said pause region respectively, and which are spaced apart from said pause region in the longitudinal direction such that said first and second turning regions respectively correspond to first and second biased movements of said proximate cord segment with said cord retaining region which are caused by the biasing force when said toothed segment is in the unlocked position, and such that said pause region corresponds to a pulled movement of said proximate cord segment relative to said cord retaining region against the biasing force when said toothed segment is in the unlocked position;

a guided member which has a key end that is disposed to be guided along said guideway such that said key end cooperates with the wheel axis to define first, second, third, and fourth radii, respectively, in said first route, said first turning region, said pause region, and said second turning region, and such that said first radius is longer than said second radius, and said third radius is longer than said fourth radius but shorter than said second radius, said guided member further having a restricted end which is opposite to said key end and which is inserted into and which is slidable along said restricting groove; and a linkage which is disposed to couple said cord-release controlling member with said surrounding major wall such that when said cord-release controlling member is moved along the running path towards said locking wheel, said locking wheel is turned from the locked position to the unlocked position, and such that when said toothed segment is in the unlocked position, said cord retaining region remains unmoved in each of said first turning, pause and second turning regions.

2. The pull cord device of claim 1, wherein said cord-release controlling member has a sliding piece which is slidable along the running path, and two leaf springs which are mounted on said sliding piece and which are spaced apart from each other in a direction transverse to the running path to serve as said cord retaining region so as to clamp said proximate cord segment therebetween with the holding friction force.

3. The pull cord device of claim 1, wherein said linkage is pivotally connected to said cord-release controlling member and said surrounding major wall so as to turn said locking wheel clockwise or counterclockwise when said cord-release controlling member is moved along the running path.

4. The pull cord device of claim 1, wherein said restricting groove confronts said surrounding major wall, and extends in a direction radial to the wheel axis.

5. A window covering comprising:

a header rail;

a base rail which is movable relative to said header rail in an upright direction;

a plurality of slats disposed between said header and base rails;

a housing which is disposed on one of said header rail and said base rail, and which has a restricting groove disposed therein;

a spring motor which is disposed in said housing, and which has a coil spring that has a biasing force and that is wound about a winding axis;

a first cord spool which is disposed in said housing to rotate about a first rotating axis that is parallel to the winding axis, which has a first spool hub surrounding the first rotating axis, and a first toothed gear wheel that is disposed radially and outwardly of said first spool hub relative to the first rotating axis, and which is configured to be biased by the biasing force of said coil spring to rotate;

a first pull cord having a leading cord end which is coupled with said first spool hub so as to permit said first pull cord to be wound thereon, a tailing cord end which is opposite to said leading cord end, and which is connected to the other one of said header and base rails, and a cord body which is interposed between said leading and tailing cord ends, and which includes proximate and distal cord segments relative to said leading cord end, said proximate cord segment being disposed such that when said leading cord end is being reeled on or off said first spool hub, said proximate cord segment moves along a running path in a longitudinal direction that is transverse to the upright direction;

a locking wheel mounted in and rotatable relative to said housing about a wheel axis parallel to the winding axis, and including a rim surrounding the wheel axis, a surrounding major wall extending from said rim in radial directions and towards the wheel axis, and a toothed segment which is disposed on said rim, and which is turnable between a locked position where said toothed segment engages one of said toothed gear wheel and said spring motor, and an unlocked position where said toothed segment disengages from said one of said toothed gear wheel and said spring motor, the locked position being disposed behind the unlocked position in terms of a rotating direction of said locking wheel;

a cord-release controlling member including a cord retaining region engaging said proximate cord segment with a holding friction force such that, when said toothed segment is in the unlocked position, said cord retaining region is movable with said proximate cord segment along the running path by virtue of counteraction of the holding friction force against the biasing force, and such that, when said toothed segment is in the unlocked position, and when a pulling force is exerted on said distal cord segment to pull said proximate cord segment against the biasing force, said proximate cord segment is movable relative to said cord retaining region once said cord-release controlling member is prevented from moving away from said locking wheel;

a guideway disposed in said surrounding major wall, and including a first route which extends angularly about the wheel axis from an initial region to an interval region such that said first route corresponds to movement of said toothed segment between the locked and unlocked positions, and a looped route starting from and ending at said interval region, and defining a pause region, and first and second turning regions which are disposed upstream and downstream of said pause region respectively, and which are spaced apart from said pause region in the longitudinal direction such that said first and second turning regions respectively correspond to first and second biased movements of said proximate cord segment with said cord retaining region which are caused by the biasing force when said toothed segment is in the unlocked position, and such that said pause region corresponds to a pulled movement of said proximate cord segment against the biasing force when said toothed segment is in the unlocked position;

a guided member which has a key end that is disposed to be guided along said guideway such that said key end cooperates with the wheel axis to define first, second, third, and fourth radii, respectively, in said first route, said first turning region, said pause region, and said second turning region, and such that said first radius is longer than said second radius, and said third radius is longer than said fourth radius but shorter than said second radius, said guided member further having a restricted end which is opposite to said key end and which is inserted into and which is slidable along said restricting groove; and a linkage which is disposed to couple said cord-release controlling member with said surrounding major wall such that when said cord-release controlling member is moved along the running path towards said locking wheel, said locking wheel is turned from the locked position to the unlocked position, and such that, when said toothed segment is in the unlocked position, said cord retaining region remains unmoved in each of said first turning, pause and second turning regions.

6. The window covering of claim 5, further comprising:

a second cord spool which is disposed in said housing to rotate about a second rotating axis that is parallel to the winding axis, which has a second spool hub surrounding the second rotating axis, and a second toothed gear wheel that is disposed radially and outwardly of said second spool hub relative to the second rotating axis, and which is configured to be biased by said coil spring to rotate; and a second pull cord having a first cord end which is coupled with said second cord spool so as to permit said second pull cord to be wound thereon, and a second cord end which is opposite to said first cord end, which is connected to the other one of said header and base rails, and which is connected to said tailing cord end of said first pull cord.

7. The window covering of claim 6, further comprising two cord guiding members which are disposed on said other one of said header and base rails and which are spaced apart from each other in the longitudinal direction, said cord guiding members respectively having guide holes to permit passage of said tailing cord end and said second cord end, respectively, so as to guide movement of said first and second pull cords.

8. The window covering of claim 6, wherein said spring motor has a take-up drum which is wound with said coil spring, a drive drum which meshes with said take-up drum and said toothed gear wheel of said first cord spool, respectively, and which has said coil spring wound thereon so as to be rotatable clockwise by the biasing force of said coil spring, said take-up drum meshing with said second cord spool such that said second cord spool is rotated clockwise when said take-up drum rotates counterclockwise.

9. The window covering of claim 5, wherein said cord-release controlling member has a sliding piece which is slidable along the running path, and two leaf springs which are mounted on said sliding piece and which are spaced apart from each other in a direction transverse to the running path to serve as said cord retaining region so as to clamp said proximate cord segment therebetween with the holding friction force.

10. The window covering of claim 5, wherein said linkage is pivotally connected to said cord-release controlling member and said surrounding major wall so as to turn said locking wheel clockwise or counterclockwise when said cord-release controlling member is moved along the running path.

11. The window covering of claim 5, wherein said restricting groove confronts said surrounding major wall, and extends in a direction radial to the wheel axis.

* * * * *